US011458348B1

(12) United States Patent
Wang

(10) Patent No.: US 11,458,348 B1
(45) Date of Patent: Oct. 4, 2022

(54) DUMBBELL AND FITNESS EQUIPMENT

(71) Applicant: Danni Wang, Ningbo (CN)

(72) Inventor: Danni Wang, Ningbo (CN)

( * ) Notice: Subject to any disclaimer, the term of this patent is extended or adjusted under 35 U.S.C. 154(b) by 0 days.

(21) Appl. No.: 17/403,839

(22) Filed: Aug. 16, 2021

(30) Foreign Application Priority Data

Apr. 22, 2021 (EM) ..... 008515357

(51) Int. Cl.
*A63B 21/075* (2006.01)
*A63B 21/072* (2006.01)

(52) U.S. Cl.
CPC ..... *A63B 21/075* (2013.01); *A63B 21/0722* (2015.10); *A63B 21/0726* (2013.01); *A63B 21/0728* (2013.01)

(58) Field of Classification Search
CPC ..... A63B 21/0722; A63B 21/0726; A63B 21/0728; A63B 21/075; A63B 21/0004; A63B 21/072; A63B 21/0724
See application file for complete search history.

(56) References Cited

U.S. PATENT DOCUMENTS 5,033,740 A * 7/1991 Schwartz ..... A63B 21/0722 482/106
5,090,693 A * 2/1992 Liang ..... A63B 21/0726 482/108
D920,449 S * 5/2021 Wang ..... D21/681
2008/0220952 A1* 9/2008 Yang ..... A63B 21/0728 482/107

* cited by examiner

*Primary Examiner* — Megan Anderson

(57) ABSTRACT

The disclosure relates to a dumbbell, which includes a first grip rod and a counterweight assembly connected to both ends of the first grip rod, and the counterweight assembly is connected to the first grip rod through a thread structure. As the counterweight assembly of the dumbbell is connected to the first grip rod through the thread structure, different counterweights can be combined and shared to adjust the weight, thus involving a simple and flexible assembly, and the thread structure obtain a firmly connection, so that the counterweights are not easy to loosen or shake, so as to guarantee a high usage safety.

19 Claims, 11 Drawing Sheets

200

300

400

500

600

DUMBBELL AND FITNESS EQUIPMENT

TECHNICAL FIELD

This disclosure relates to a technical field of fitness equipment, specifically to a dumbbell and fitness equipment.

BACKGROUND

In order to keep healthy, people use different fitness equipment for exercise, and dumbbells are relatively common fitness equipment. A dumbbell includes a first grip rod and counterweights, and there are multiple counterweights with the same or different weights, so that when the user works out, different users choose the counterweights with different weights to assemble with the first grip rod and then exercise.

However, the replacement operation of dumbbells in the prior art are complex, which involves firstly removing the back fasteners, dismounting the counterweights, then replacing to the counterweights of the desired weight, and getting the fasteners tightened. In this case, the assembly steps are complex and may easily cause difficulties in assembly or lead to injury to the user.

SUMMARY

The present disclosure provides a dumbbell for solving the problem of acquiring a simple and flexible counterweight assembly of dumbbells.

To achieve the above purpose, the present disclosure provides a dumbbell, which includes a first grip rod and a counterweight assembly connected to both ends of the first grip rod, and the counterweight assembly is threadedly connected to the first grip rod.

In one embodiment, the first grip rod is formed with external threads at both ends, the counterweight assembly comprises a first counterweight, one end of the first counterweight defines a screw hole, and the screw hole is capable of threadedly connecting with the external threads.

In another embodiment, the other end of the first counterweight further defines another screw hole, the counterweight assembly further comprising a second counterweight, wherein a stud is formed at one end of the second counterweight, and the stud is capable of threadedly connecting to the screw holes of the first counterweight.

In another embodiment, the counterweight assembly further comprises a third counterweight, another stud is formed at one end of the third counterweight, another screw hole is formed at the other end of the second counterweight, and the stud of the third counterweight is capable of threadedly connecting to the screw holes of the second counterweight and the first counterweight.

In another embodiment, each of both ends of the first grip rod defines a screw hole, the counterweight assembly comprises a second counterweight, and the second counterweight is formed with a stud at one end thereof, the stud is capable of threadedly connecting to the screw hole.

In another embodiment, another stud is formed at one end of the third counterweight, and another screw hole is formed at the other end of the second counterweight, and the screw hole of the second counterweight is capable of threadedly connecting to the studs of the third counterweight and the second counterweight.

In another embodiment, the dumbbell further comprises a first washer, the first washer is received between any two adjacent ones of the first counterweight, the second counterweight, and the third counterweight, or the first washer is sleeved on the first counterweight, the second counterweight or the third counterweight.

In another embodiment, end surfaces of the first counterweight, the second counterweight, and the third counterweight are provided with a chamfer, and adjacent chamfers of the first counterweight, the second counterweight or the third counterweight form an annular groove, and the first washer is received and fixed in the annular groove.

In another embodiment, the dumbbell further comprises a second washer, snf the second washer is sleeved on the stud of the second counterweight and/or on the stud of the third counterweight.

In another embodiment, an outer side of the second washer projects from an outer side of the second counterweight or that of the third counterweight.

In another embodiment, the other end of the third counterweight is flat.

In another embodiment, the first counterweight, the second counterweight or the third counterweight is circular or polygonal in shape.

In a further embodiment, an anti-slip groove is formed on a surface of the first grip rod.

The disclosure also provides a fitness equipment comprising a second grip rod and a dumbbell as described above, wherein a length of the second grip rod is greater than a length of the first grip rod, and two dumbbells are separately jointed with two opposite ends of the second grip rod in a threaded connection.

In a further embodiment, the second grip rod is integrally formed; or, the second grip rod is assembled in a detachable manner.

The disclosure involves beneficial effects that: the counterweight of the above dumbbell is connected to the first grip rod through a thread structure, the thread structure obtaining a firm connection, thus avoiding the counterweight getting loosen or shaking, and guaranteeing a high usage safety; the counterweights can be combined and shared with each other to adjust the weight, the assembly operation and the counterweight is flexible; the number of counterweights can be increased infinitely to form dumbbells in various weights combination.

DETAILED DESCRIPTION

The present disclosure is described in details with reference of FIGS. 1-8.

Figure 1:
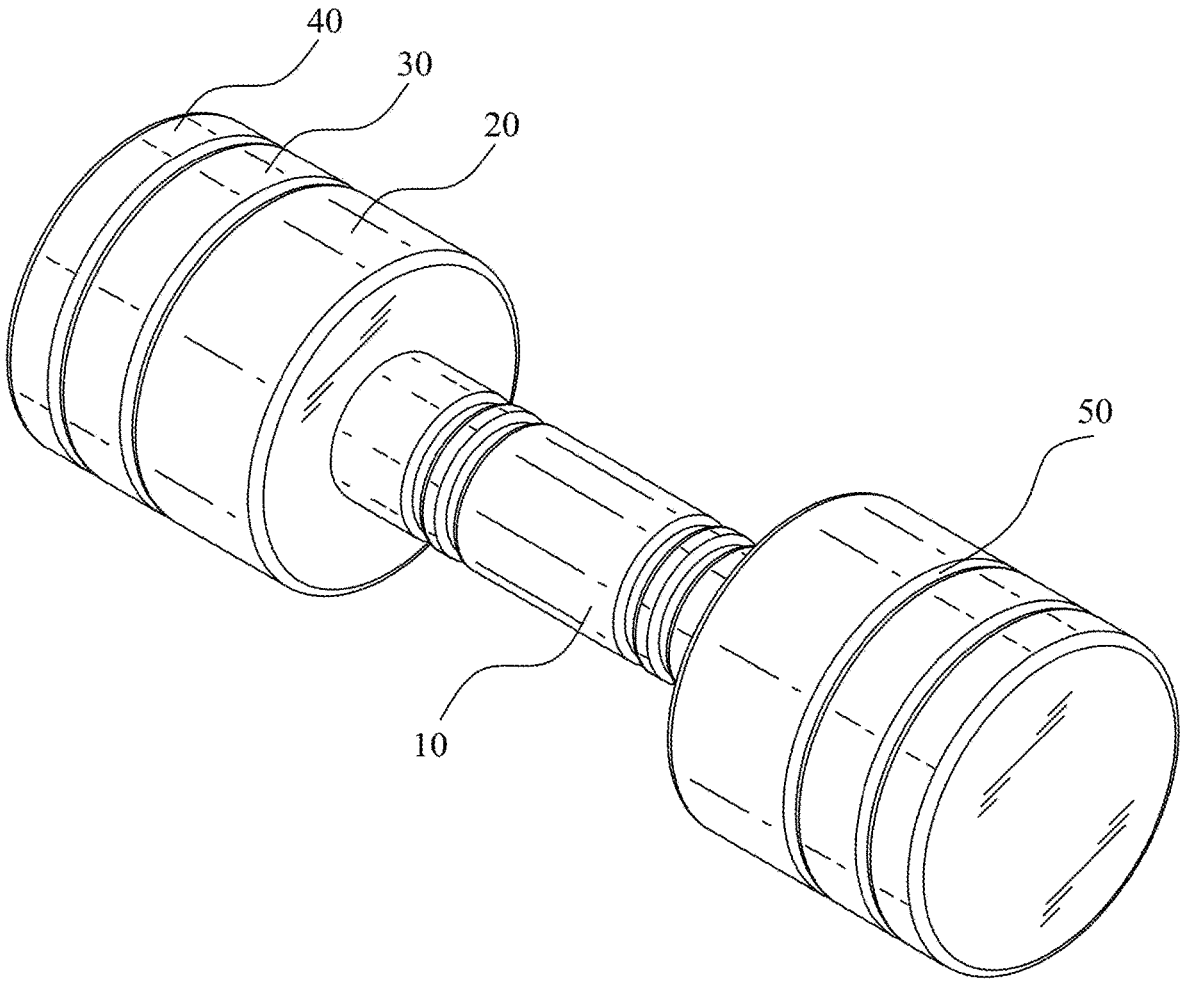
FIG. 1 illustrates a three-dimensional structure of the dumbbell of a first embodiment of the disclosure.
Figure 2:
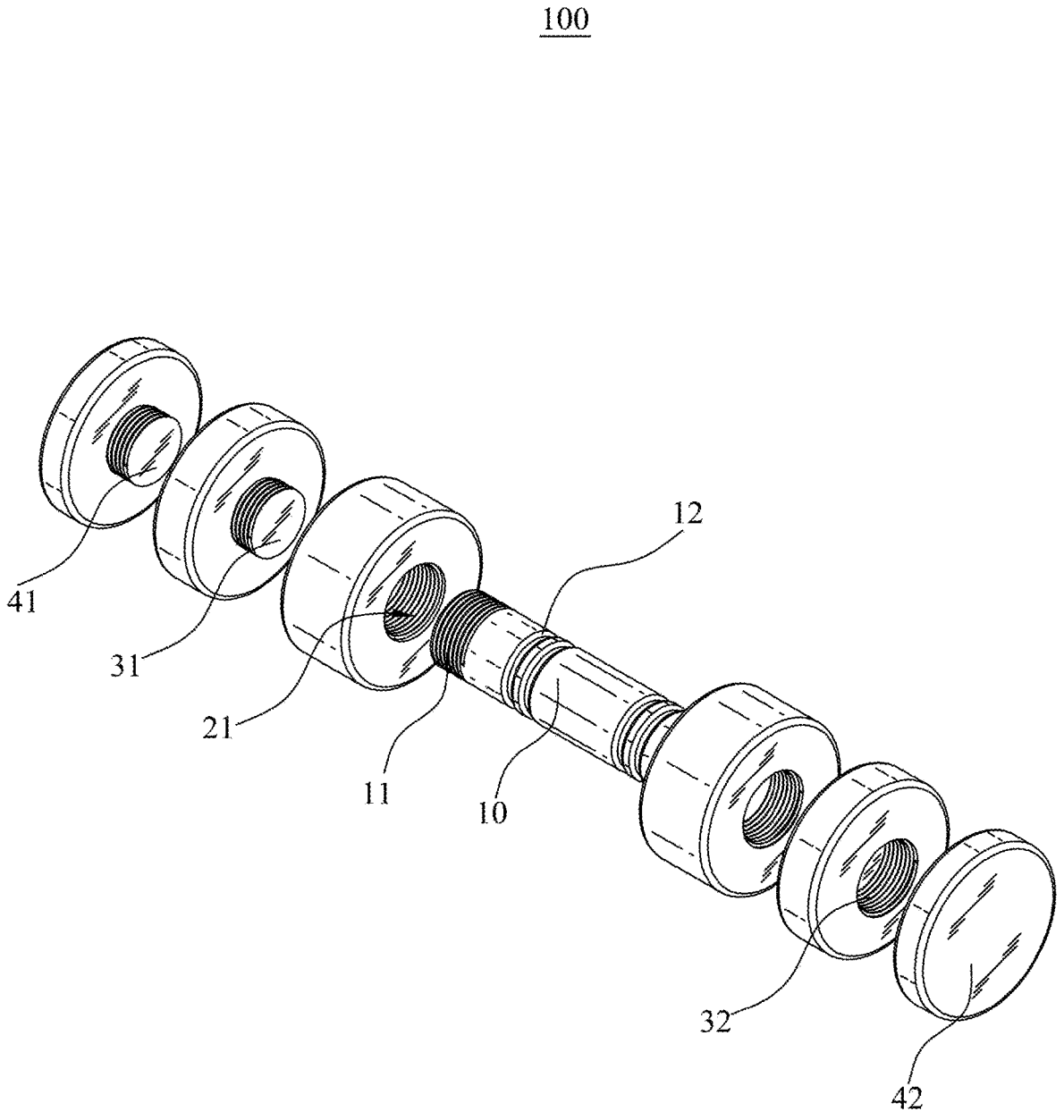
FIG. 2 is a schematic diagram of an exploded structure of the dumbbell shown in FIG. 1.

Referring to FIGS. 1 and 2, in the first embodiment of the disclosure, the dumbbell 100 includes a first grip rod 10 and a counterweight assembly connected to both ends of the first grip rod 10, and the counterweight assembly includes one or more of a first counterweight 20, a second counterweight 30, and a third counterweight 40. Herein, in the case that the counterweight assembly includes one or more of the first counterweight 20, the second counterweight 30, and the third counterweight 40, the first counterweight 20 is connected to the first grip rod 10 through a thread structure, and the first counterweight 20 and the second counterweight 30 adjacent thereto, as well as the second counterweight 30 and the third counterweight 40 thereto, are connected to each other through a thread structure. Since the first counterweight 20 of the dumbbell 100 is connected to the first grip rod 10 by the thread structure, the thread structure obtains a firm connection, and the first counterweight 20 is not easy to loosen or shake, so as to achieve a high usage safety, and the assembly is simple and flexible. The first counterweight 20 is connected with the second counterweight 30 through a thread structure, and the second counterweight 30 and the third counterweight 40 are also connected by a thread structure, so that the first grip rod 10 and the first counterweight 20, the second counterweight 30 and the third counterweight 40 form a whole, thus increasing the stability of the dumbbell 100. The first counterweight 20, the second counterweight 30 and the third counterweight 40 may share the same thread size, and the counterweights can be interchangeably shared to assemble dumbbells of various weights.

Specifically, as shown in FIGS. 1 and 2, the dumbbell 100 includes a first grip rod 10, and a first counterweight 20, a second counterweight 30 and a third counterweight 40, symmetrically disposed at both ends of the first grip rod 10. Herein, the first grip rod 10 is cylindrical and both ends of the first grip rod 10 are formed with external threads 11, and a middle surface of the first grip rod 10 is provided with a plurality of annular anti-slip grooves 12, so that the flipping trough hands will not easily happen when user holds the first grip rod 10.

The first counterweight 20 defines a screw hole 21, which in this embodiment is a through hole. It is understood that in other embodiments, the screw holes 21 may also be blind holes defined at each end of the first counterweight 20. The first counterweight 20 is detachably fixed to the first grip rod 10 by screwing the screw holes 21 with the external threads 11.

The second counterweight 30 includes a stud 31 formed at one end of the second counterweight 30, and a screw hole 32 formed at the other end. The second counterweight 30 is connected to the first counterweight 20 by screwing the stud 31 with the screw holes 21.

A stud 41 is formed at one side of the third counterweight 40, while the other side thereof is a flat surface 42, and the stud 41 is screwed to the screw hole 32 to connect the third counterweight 40 to the second counterweight 30. In other words, the first counterweight 20 is configured to connect with the first grip 10, and the second counterweight 30 is configured to connect the first counterweight 20 and the third counterweight 40.

In order to facilitate assembly, the first counterweight 20, the second counterweight 30 and the third counterweight 40 have the same thread structure size. Specifically, the inner diameters of the screw holes 21 and 32, as well as the outer diameters of the studs 31 and 41 are the same, and the inner diameters of the screw holes 21 and 32 and the outer diameters of the studs 31 and 41 are the same. Similarly, the outer diameter of the external thread 11 of the first grip rod 10 is the same as the inner diameter of the screw hole 21 and the screw hole 32 so that the first counterweight 20 is detachably connected to the first grip rod 10 by screwing the screw hole 21 with the external thread 11.

In this embodiment, the first counterweight 20, the second counterweight 30, and the third counterweight 40 are circular in shape. In other embodiments, the first counterweight 20, the second counterweight 30, and the third counterweight 40 may be shaped as polygons such as hexagons to facilitate assembly operations.

In other embodiments, at least two second counterweights 30 may be disposed between the first counterweight 20 and the third counterweight 40, and the first counterweight 20 and the second counterweight 30 adjacent thereto are connected by screwing the stud 31 with the screw hole 21, while the two adjacent second counterweights 30 are connected by screwing the stud 32 with the screw hole 31, and the second counterweight 30 and the third counterweight 40 adjacent thereto are connected by screwing the stud 41 with the screw hole 32.

In other embodiments, the third counterweight 40 may be directly connected to the first counterweight 20, and the first counterweight 20 is then connected to the first grip rod 10, and there is no need to dispose the second counterweight 30 therebetween to connect the first counterweight 20 with the third counterweight 40. Alternatively, only one second counterweight 30 is connected to the first grip rod 10, and specifically, the second counterweight is connected to the external thread 11 of the first grip rod 10 through the screw hole 32. It can be seen that the first counterweight 20, the second counterweight 30, the third counterweight 40 and the first grip rod 10 can be freely assembled with each other, in which case the dumbbell 100 involves different assembly methods, and different users can assemble it according to their needs, so as to meet the needs of different users.

Figure 3:
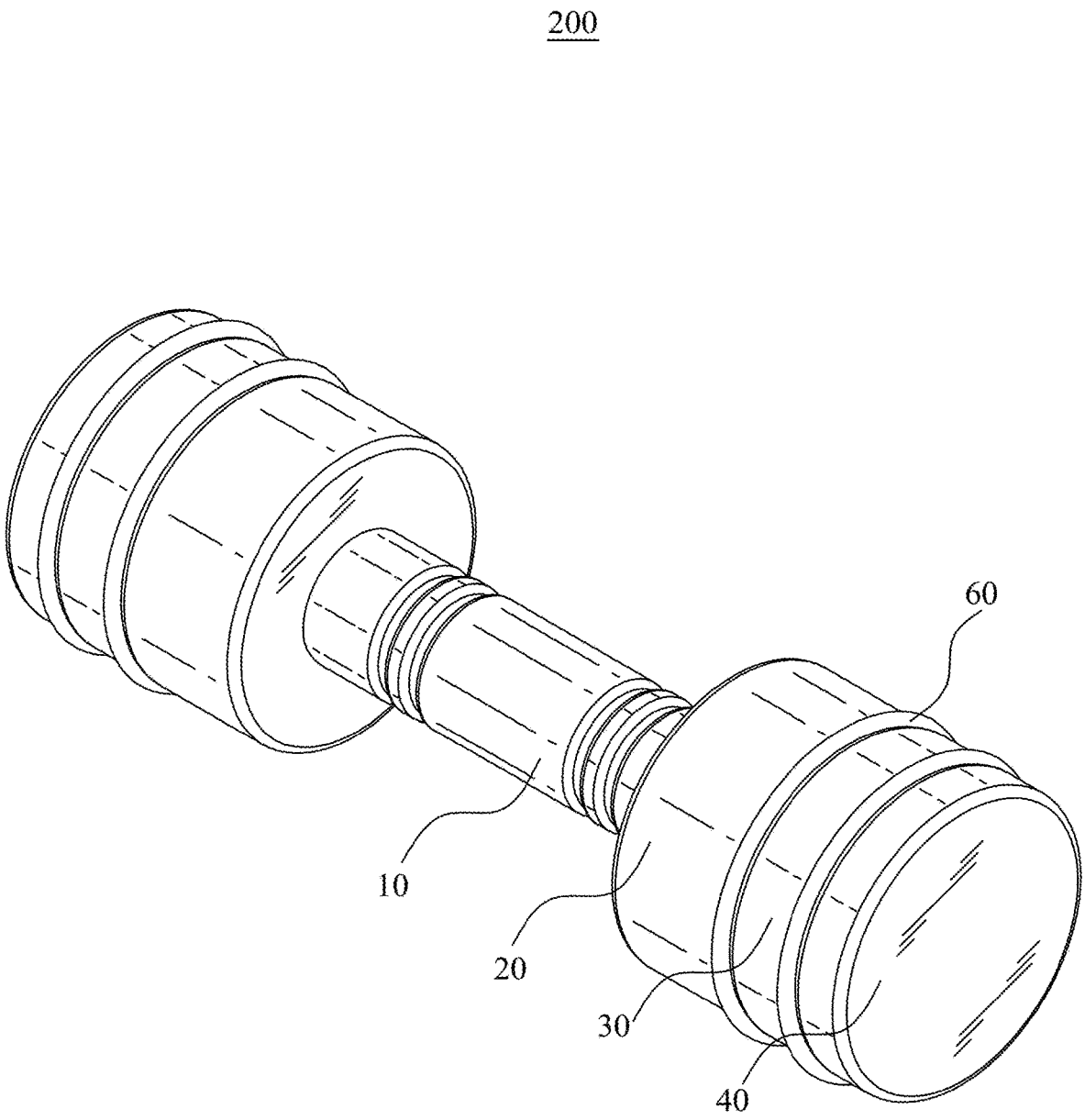
FIG. 3 illustrates a three-dimensional structure of the dumbbell of a second embodiment of the disclosure.
Figure 4:
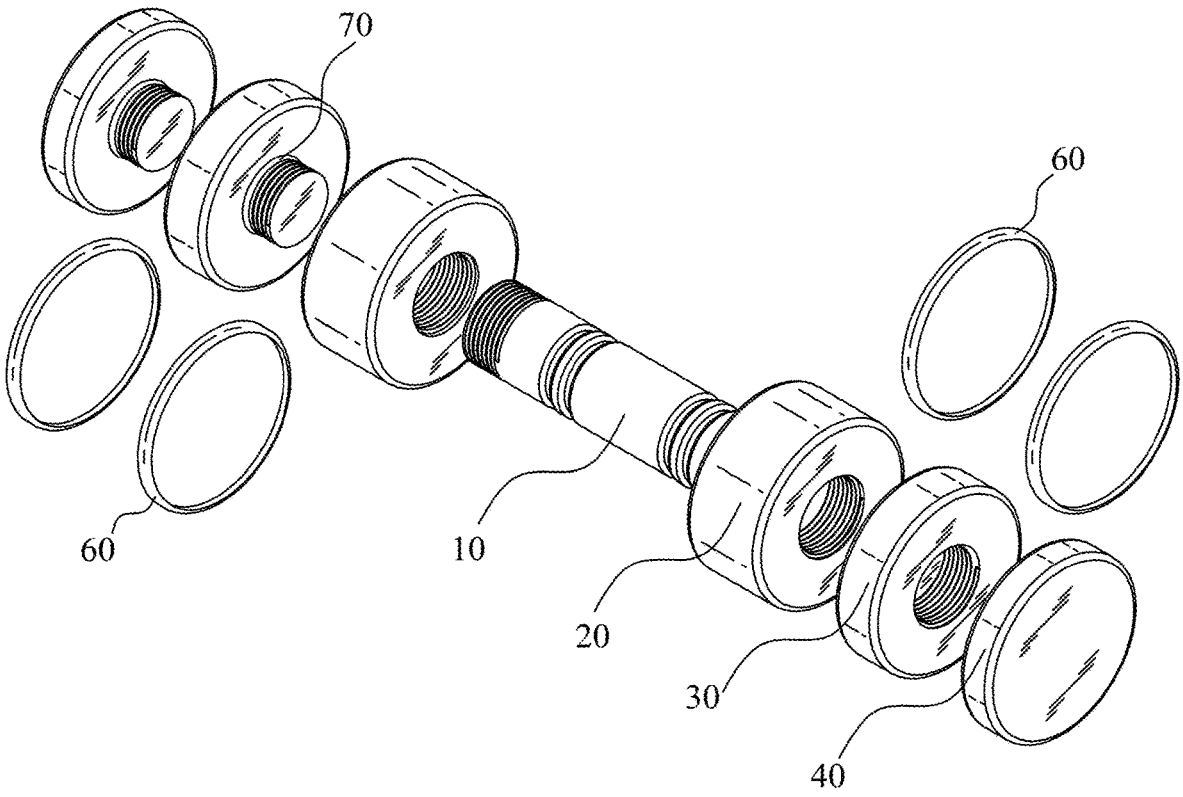
FIG. 4 is a schematic diagram of an exploded structure of the dumbbell shown in FIG. 3.

FIG. 3 is a three-dimensional structure diagram of the dumbbell 200 of the second embodiment of the disclosure, and FIG. 4 is a schematic diagram of the exploded structure of the dumbbell 200 shown in FIG. 3. The difference with the first embodiment is that the dumbbell 200 also includes a first washer 60, and the first washer 60 is received between the first counterweight 20 and the second counterweight 30 adjacent thereto, and between the second counterweight 30 and the third counterweight 40 adjacent thereto.

Referring together to FIGS. 1, 3 and 4, end surface edges of both sides of the first counterweight 20 and the second counterweight 30 are provided with chamfers, and a chamfer is also formed at the end surface edge of one end of the second counterweight 30. When the first counterweight 20, the second counterweight 30 and the third counterweight 40 are connected together, the chamfers of the first counterweight 20 and the second counterweight 30 would form an annular groove 50, and the chamfers of the second counterweight 30 and the third counterweight 40 also form another annular groove 50, the first washer 60 is received and fixed in the annular grooves 50, and the first washer 60 projects from the surface of the first counterweight 20, the second counterweight 30 and the third counterweight 40. It can be seen that the first washer 60 is received between the first counterweight 20 and the second counterweight 30, as well as between the second counterweight 30 and the third counterweight 40, and the first washer 60 projects from the surface of the first counterweight 20, the second counterweight 30 and the third counterweight 40 so as to achieve the effect of isolation from the ground, reducing the wear of the first counterweight 20, the second counterweight 30 and the third counterweight 40, and as well as avoiding the wear to the ground. The structure is simple and practical.

In other embodiments, the first washer 60 can be sleeved on the outer side of the first counterweight 20, the second counterweight 30 and the third counterweight 40, so that the first washer 60 will contact the ground before the first counterweight 20, the second counterweight 30 and the third counterweight 40, thus isolating the ground from the first counterweight 20, the second counterweight 30 and the third counterweight 40. In order to increase the friction of the first washer 60, an outer side of the first washer 60 is provided with a non-slip structure, such as a pattern, knurling, bump structure, etc.

The dumbbell 200 may also include a second washer 70, the second washer 70 is sleeved on the stud 31 or stud 41; the second washer 70 has an outer side projecting from the outer side of the second counterweight 30 or the third counterweight 40. When the first counterweight 20 connects with the second counterweight 30 by the thread structure, and the second counterweight 30 connects with the third counterweight 40 by the thread structure, the second washer 70 is clamped between the first counterweight 20 and the second counterweight 30 and between the second counterweight 30 and the third counterweight 40, so as to prevent the user from screwing the threads that hard to cause jamming problem between the first counterweight 20 and the second counterweight 30 and between the second counterweight 30 and the third counterweight 40.

Figure 5:
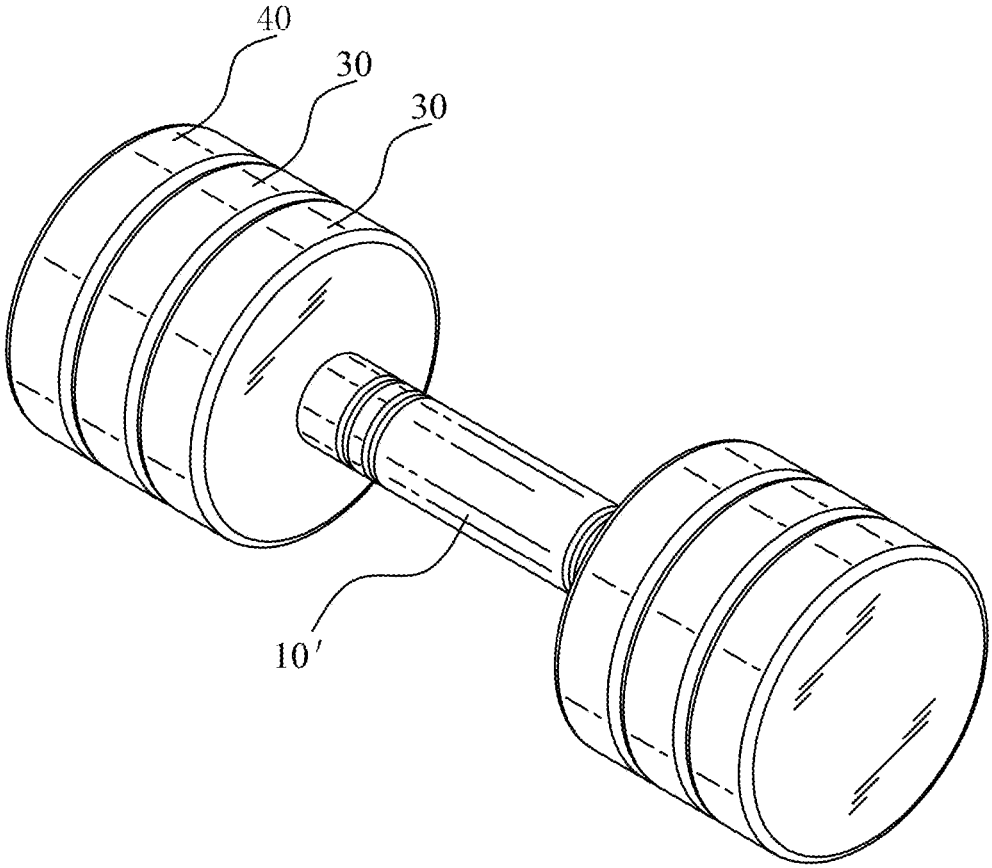
FIG. 5 illustrates a three-dimensional structure of the dumbbell of a third embodiment of the present disclosure.
Figure 6:
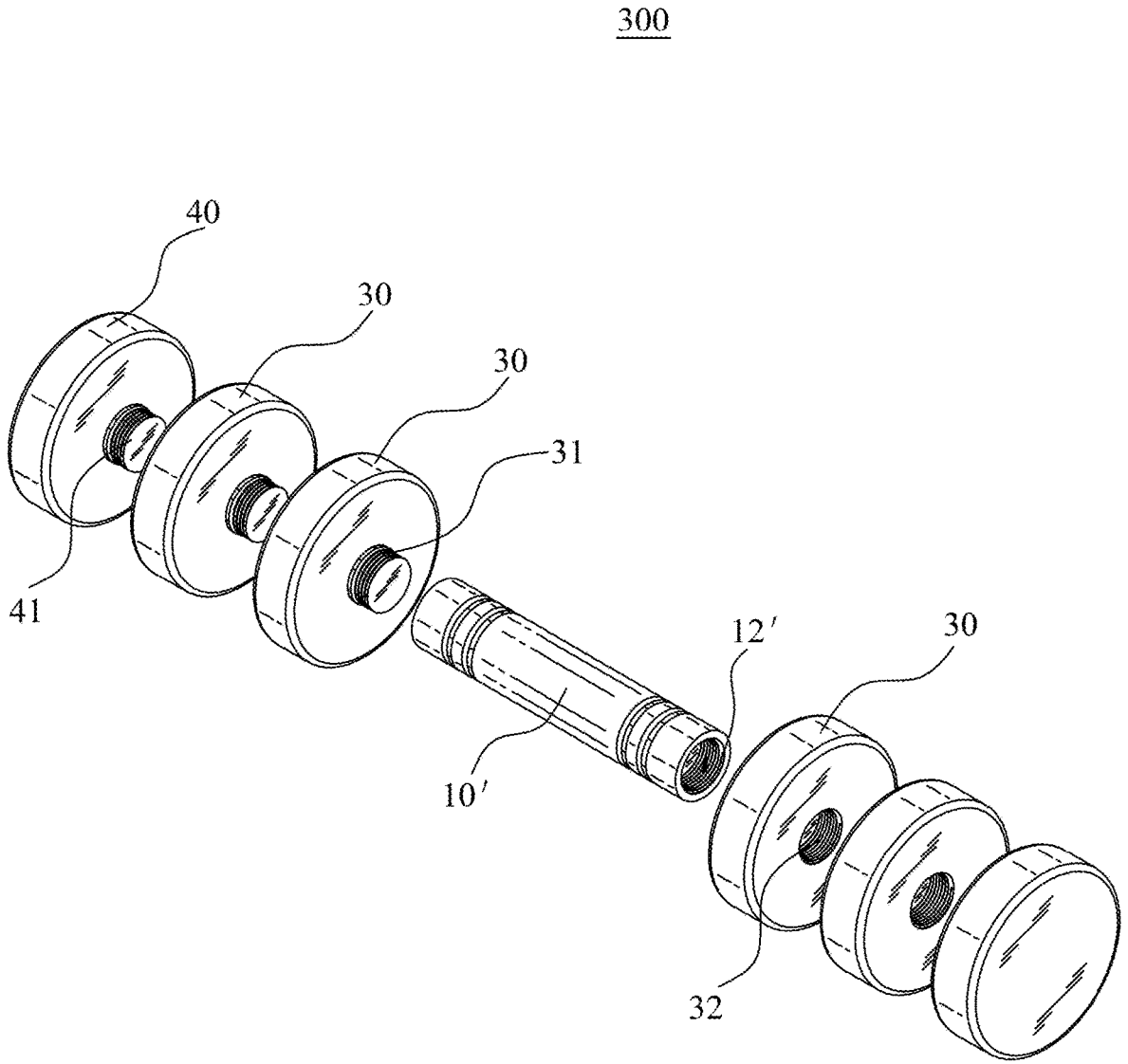
FIG. 6 is a schematic diagram of an exploded structure of the dumbbell shown in FIG. 5.

FIG. 5 is a three-dimensional structure diagram of the dumbbell 300 of the third embodiment of the disclosure, and FIG. 6 is a schematic diagram of the exploded structure of the dumbbell 300 shown in FIG. 5. In this embodiment, the dumbbell 300 includes a first grip rod 10' and a counterweight assembly connected to both ends of the first grip rod 10', wherein the counterweight assembly includes a second counterweight 30 and a third counterweight 40.

Referring to FIGS. 5 and 6, in this embodiment, each of both ends of the first grip rod 10' defines a screw hole 12' at both ends, i.e., the screw holes 12' are recessed and formed in the end surface of the first grip rod 10'. The screw holes 12' are concave holes with internal threads.

Specifically, the first grip rod 10' is connected to two second counterweights 30 and one third counterweight 40, wherein one of the second counterweight 30 is detachably mounted to the first grip rod 10' through the match between stud 31 and screw hole 12', and the other second counterweight 30 is connected to the aforementioned screw hole 32 of the second counterweight 30 and stud 41 of the third counterweight 40 through stud 31 and screw hole 32, respectively.

Figure 7:
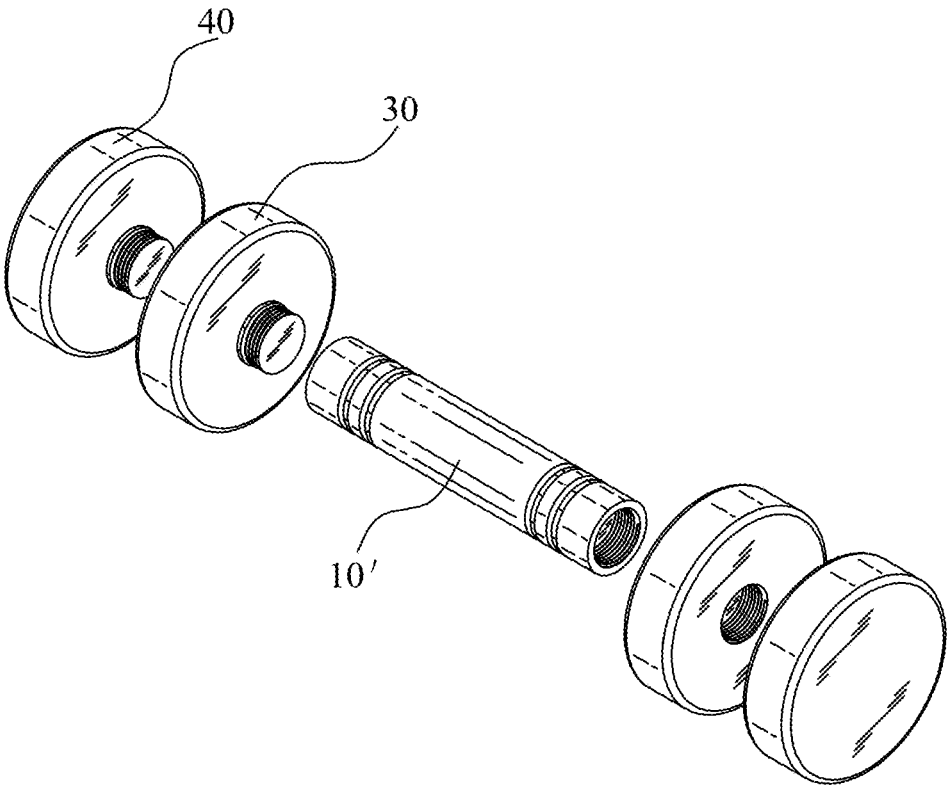
FIG. 7 is a schematic diagram of an exploded structure of the dumbbell of a fourth embodiment of the disclosure.

FIG. 7 is a schematic diagram of the exploded structure of the dumbbell 400 of the fourth embodiment of the disclosure. The difference with the third embodiment is that one second counterweight 30 and a third counterweight 40 are connected to each end of the first grip rod 10' of the dumbbell 400 of this embodiment, and the second counterweight 30 connects the first grip rod 10' and the third counterweight 40.

Figure 8:
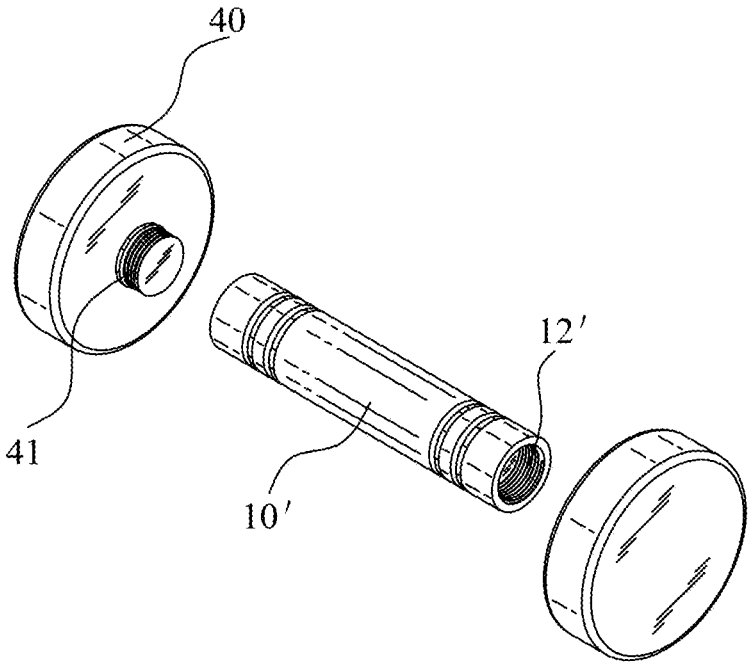
FIG. 8 is a schematic diagram of an exploded structure of the dumbbell of a fifth embodiment of the disclosure.

FIG. 8 is a schematic diagram of the exploded structure of the dumbbell 500 of the fifth embodiment of the disclosure. The difference with the third embodiment is that one third counterweight 40 is connected to each end of the first grip rod 10' of the dumbbell 500 of this embodiment, and the third counterweight 40 is connected to the first grip rod 10' through the screwing the stud 41 to the screw hole 12'.

It can be understood that, in other embodiments, at least two second counterweights 30 are connected to each end of the first grip rod 10', and the studs of the second counterweights 30 are screwed to the screw holes of the first grip rod 10'. It is also understood to provide a plurality of second counterweights 30 to threadedly connect to each other.

Figure 9:
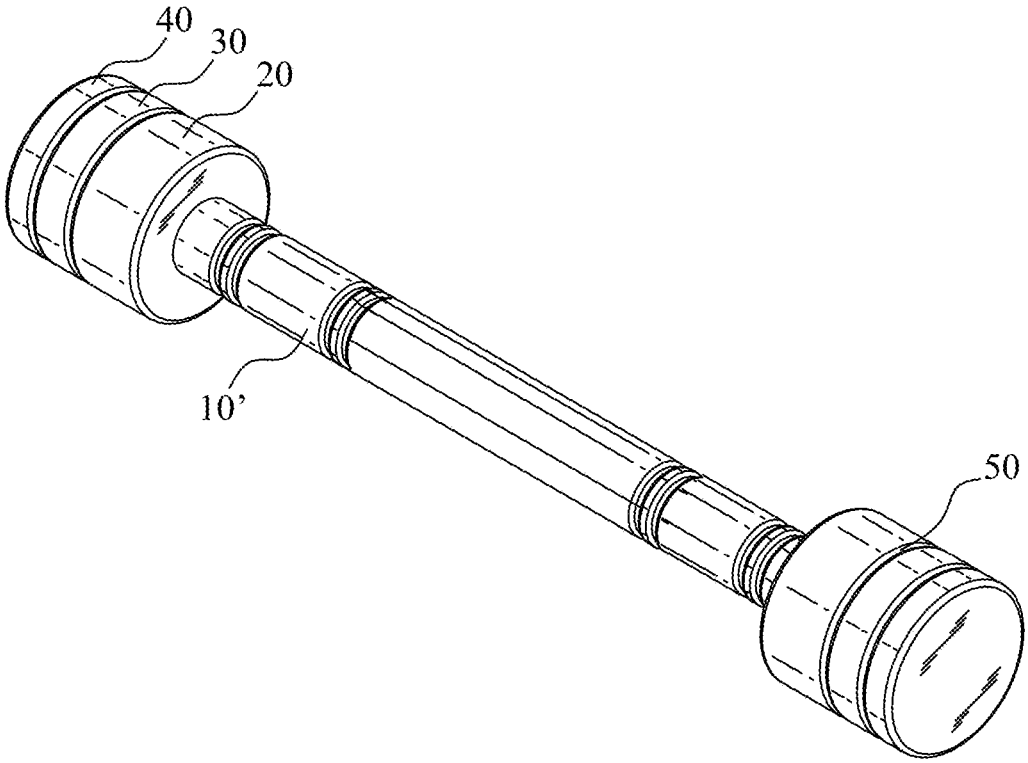
FIG. 9 is a schematic diagram of a three-dimensional structure of a fitness equipment of a first embodiment of the disclosure.

FIG. 9 is a schematic diagram of the three-dimensional structure of the fitness equipment 600 in the disclosure. The difference between this embodiment and the first embodiment is that the length of the second grip rod 10' is different, while the other structures are the same. Compared to the first to fifth embodiment, the length of the second grip rod 10' of the fitness equipment 600 is significantly increased, and the holding width of the user's hand can be wider, so that the fitness equipment 600 can be used as a barbell. The first grip rod (10, 10') of the dumbbells (100, 200, 300, 400, 500), on the other hand, has a shorter length and a narrower holding width of the user's hand, which can be suitable for the usage of a dumbbell.

The second grip rod 10' has an integrally formed structure, which is a cylindrical bar. In other embodiments, the second grip rod 10' can also be a detachable assembly, for example, a snap structure, socket structure or thread structure is formed on the second grip rod 10', and the second grip rod 10' is assembled by a plurality of second grip rods 10'. During producing and selling, multiple second grip rods 10' are separated from each other to facilitate packaging and transportation; while when used by users, users can assemble multiple second grip rods 10' to form second grip rods 10' of different lengths according to the needed length of use.

Figure 10:
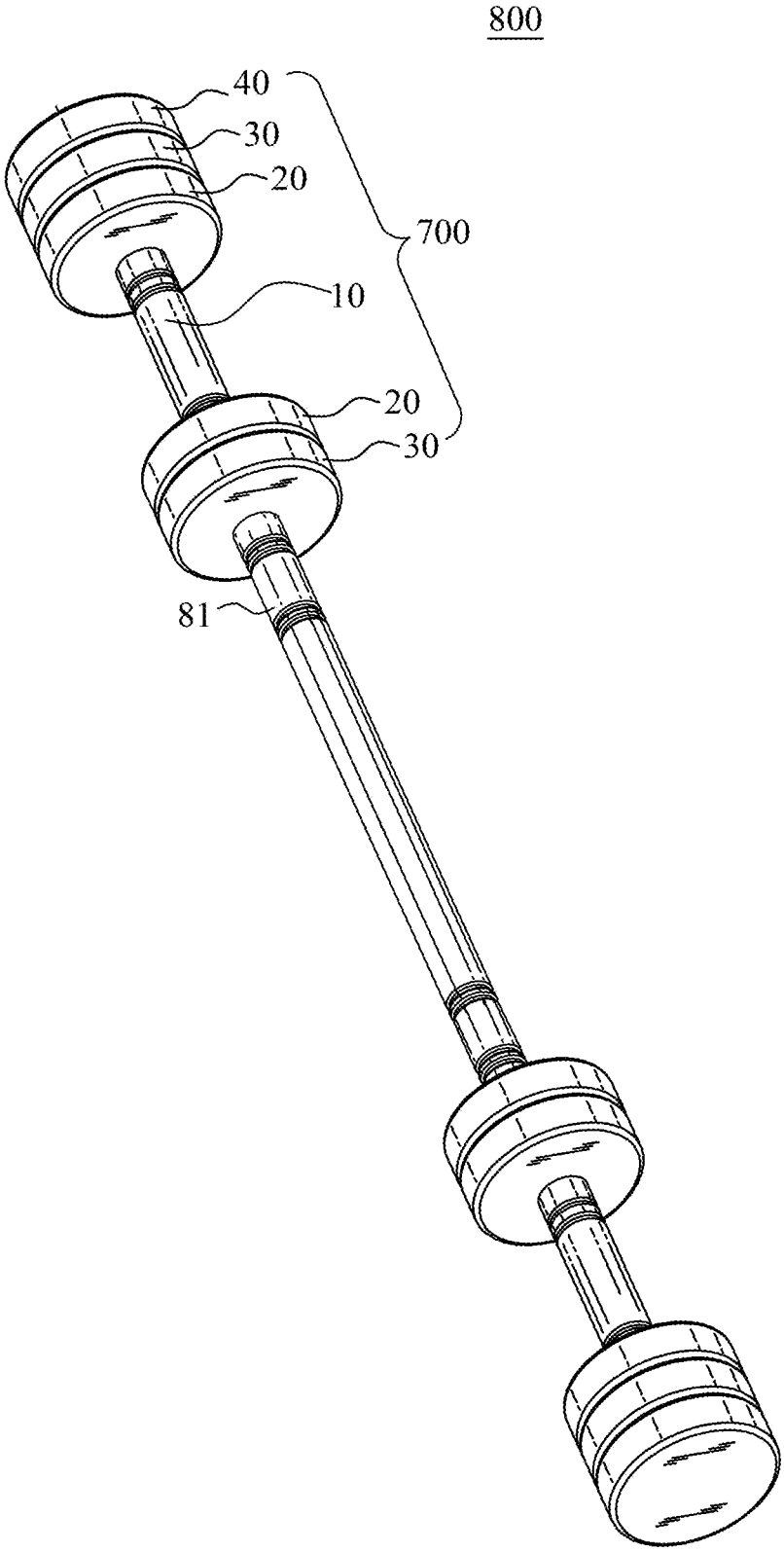
FIG. 10 is a schematic diagram of a three-dimensional structure of the fitness equipment of a second embodiment of the disclosure.

FIG. 10 is a three-dimensional structure of another fitness equipment 800 of the present disclosure. As shown in the figure, the fitness equipment 800 includes a second grip rod 81 and the above-mentioned dumbbell 700, wherein the difference between the dumbbell 700 and the dumbbell 300 is that one end of the first grip rod 10 of the dumbbell 700 is installed with the first counterweight 20 and the second counterweight 30, and the other end is installed with the first counterweight 20, the second counterweight 30 and the third counterweight 40, so that the second grip rod 81 can be connected to the first screw hole 21 of the first counterweight 20 through the external threads on two ends of the second grip rod 81 connecting to the first screw hole 21 of the first counterweight 20, so that the two dumbbells 700 can be detachably connected together. Herein, the second grip rod 81 is longer than the first grip rod 10, thus allowing the user to use the fitness equipment 800 as a barbell.

Figure 11:
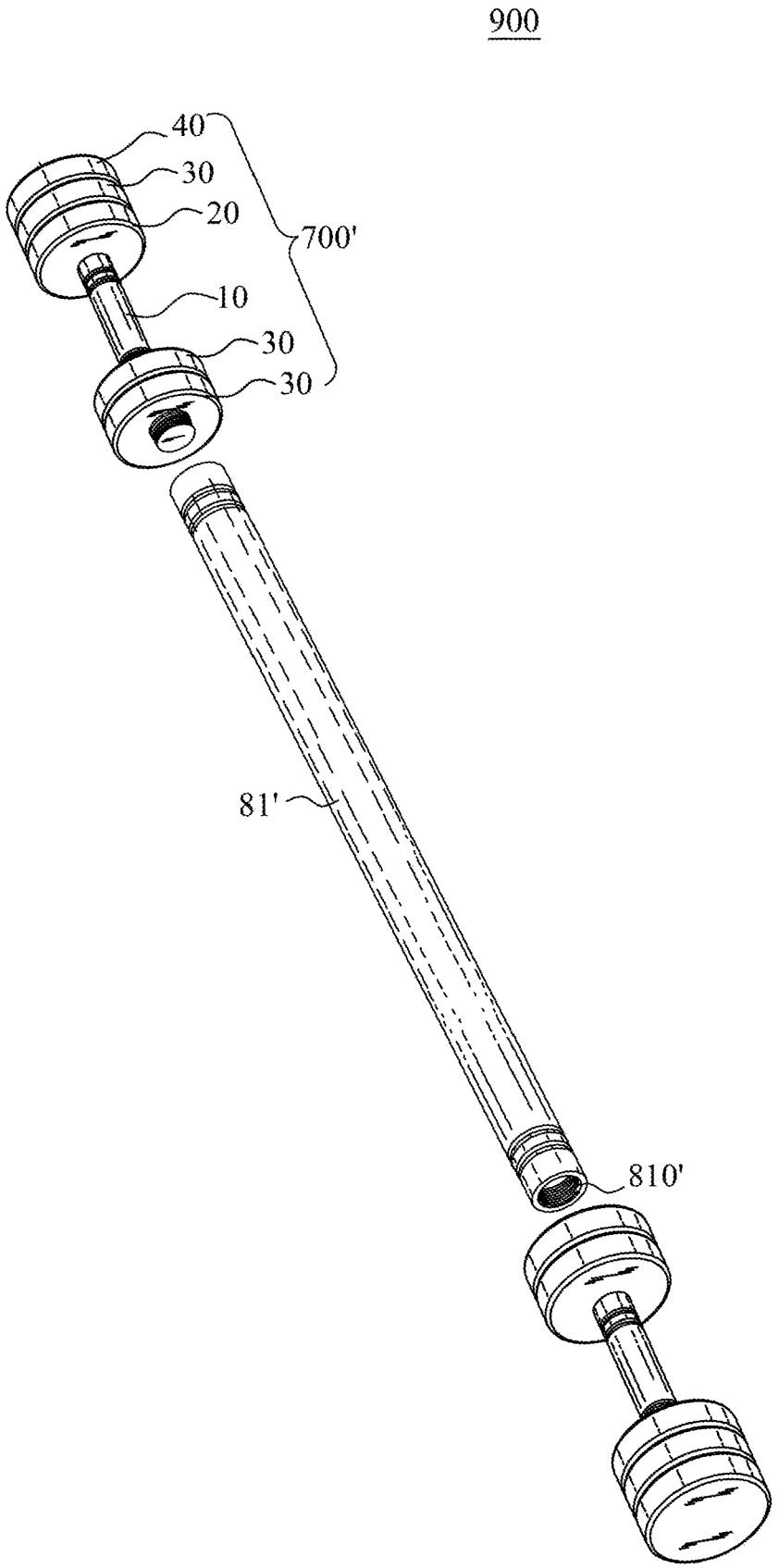
FIG. 11 is a schematic diagram of a three-dimensional structure of the fitness equipment of a third embodiment of the disclosure.

It should be understood that screw holes 810' may also be defined at both ends of the second grip rod 81', as in FIG. 11. In this configuration, the second counterweight 30 of the dumbbell 700' is threadedly connected to the screw holes 810' of the second grip rod 81'.

The above description is merely some embodiments. It should be noted that for one with ordinary skills in the art, improvements can be made without departing from the concept of the disclosure, but these improvements shall fall into the protection scope of the disclosure.

What is claimed is:

1. A dumbbell, comprising a first grip rod and two counterweight assemblies connected to both ends of the first grip rod respectively, wherein the two counterweight assemblies are threadedly connected to the first grip rod, each of the two counterweight assemblies comprises a first counterweight and a second counterweight connected to the first counterweight, first washer, the first washer is received between the first counterweight and the second counterweight adjacent to the first counterweight, or the first washer is sleeved on the first counterweight or the second counterweight.

2. The dumbbell according to claim 1, wherein both of the ends of the first grip rod are formed with external threads, one end of each of the first counterweights defines a screw hole and the screw holes are threadedly connected to the external threads.

3. The dumbbell according to claim 2, wherein the other end of each of the first counterweights further defines another screw hole, a stud is formed at one end of each of the second counterweights, and the studs of the second counterweights are configured to threadedly connect to the screw holes of the first counterweights.

4. The dumbbell according to claim 3, wherein each of the two counterweight assemblies further comprises a third counterweight, a stud is formed at one end of each of the third counterweights, another screw hole is formed at the other end of each of the second counterweights, and the studs of the third counterweights are configured to threadedly connect to the screw holes of the third counterweights.

5. The dumbbell according to claim 4, wherein the first washer is received between any two adjacent ones of the first counterweight, the second counterweight, and the third counterweight, or the first washer is sleeved on the first counterweight, the second counterweight or the third counterweight.

6. The dumbbell according to claim 5, wherein end surfaces of the first counterweight, the second counterweight, the third counterweight are provided with chamfers, adjacent chamfers of the chamfers of the first counterweight, the second counterweight or the third counterweight form an annular groove, and the first washer is received and fixed in the annular groove.

7. The dumbbell according to claim 4, wherein the dumbbell further comprises a second washer, and the second washer is sleeved on the stud of the second counterweight and/or on the stud of the third counterweight.

8. The dumbbell according to claim 7, wherein an outer side of the second washer projects from an outer side of the second counterweight or an outer side of the third counterweight.

9. The dumbbell according to claim 4, wherein the other end of the third counterweight is flat.

10. The dumbbell according claim 4, wherein the first counterweight, the second counterweight or the third counterweight is circular or polygonal in shape.

11. The dumbbell according to claim 1, wherein each of the ends of the first grip rod defines a screw hole, each of the second counterweights is formed with a stud at one end thereof, the studs are configured to threadedly connect to the screw holes.

12. The dumbbell according to claim 11, wherein each of the two counterweight assemblies further comprises a third counterweight, a stud is formed at one end of the third counterweight, and a screw hole is formed at the other end of each of the second counterweights, and the screw holes of the second counterweight are configured to threadedly connect to the studs of the third counterweights.

13. The dumbbell according to claim 12, wherein the dumbbell further comprises a second washer, the second washer is sleeved on the stud of the second counterweight and/or on the stud of the third counterweight.

14. The dumbbell according to claim 13, wherein an outer side of the second washer projects from an outer side of the second counterweight or an outer side of the third counterweight.

15. The dumbbell according to claim 12, wherein the first washer is received between the second counterweight and the third counterweight adjacent to the second counterweight, or the first washer is sleeved on the second counterweight or the third counterweight.

16. The dumbbell according to claim 12, wherein the other end of the third counterweight is flat.

17. A fitness equipment, comprising a second grip rod and a dumbbell as described in claim 1, wherein a length of the second grip rod is greater than a length of the first grip rod, and two dumbbells are separately jointed with two opposite ends of the second grip rod in a threaded connection.

18. The fitness equipment according to claim 17, wherein, the second grip rod is integrally formed; or, the second grip rod is assembled in a detachable manner.

19. The dumbbell according to claim 1, wherein a surface of the first grip rod is provided with an anti-slip groove.

* * * * *